US006390521B1

(12) United States Patent
Bohlman et al.

(10) Patent No.: US 6,390,521 B1
(45) Date of Patent: May 21, 2002

(54) DOORKNOB HANDLE

(76) Inventors: Gerald G. Bohlman; Edward W. Bohlman, both of 4992 Blue Ribbon Dr., Milton, FL (US) 32583

( * ) Notice: Subject to any disclaimer, the term of this patent is extended or adjusted under 35 U.S.C. 154(b) by 0 days.

(21) Appl. No.: 09/550,205

(22) Filed: Apr. 17, 2000

(51) Int. Cl.[7] ..... E05B 3/00; E05B 1/00

(52) U.S. Cl. ..... 292/348; 16/413; 16/DIG. 24; 16/DIG. 25

(58) Field of Search ..... 292/1, 336.3, 348, 292/349, 350, 351, DIG. 2; 16/412, 413, 441, DIG. 25, DIG. 24, DIG. 41, 900, 906

(56) References Cited

U.S. PATENT DOCUMENTS

| | | | | |
|---|---|---|---|---|
| 4,285,536 A | | 8/1981 | McCoy et al. | |
| 4,319,470 A | * | 3/1982 | White | 70/224 |
| 4,397,489 A | | 8/1983 | Lind | |
| 4,648,643 A | * | 3/1987 | Bettger | 292/347 |
| 4,913,479 A | * | 4/1990 | Allison | 292/347 |
| 4,971,375 A | * | 11/1990 | Grecco | 292/347 |
| 5,231,731 A | * | 8/1993 | Jones, Jr. | 16/412 |
| 5,288,116 A | * | 2/1994 | Donofrio | 292/336.3 |

FOREIGN PATENT DOCUMENTS

JP 2000160884 A * 6/2000

* cited by examiner

*Primary Examiner*—Anthony Knight
*Assistant Examiner*—Vishal Patel
(74) *Attorney, Agent, or Firm*—Richard C. Litman

(57) ABSTRACT

A doorknob handle assembly for retrofitting conventional rounded doorknobs, a kit for the doorknob handle's installation, and a method for using the kit to install the doorknob handle are described. The doorknob handle assembly has a doorknob handle in the form of a ring with an elongated lever extending from the outer circumference of the ring, the handle ring being threaded on its interior surface, and a locking ring having a threaded exterior surface and a slit defining a split ring. The locking ring is placed around the shaft of a conventional rounded doorknob, and the doorknob handle is placed over the face of the doorknob and threaded engaged to the locking ring in order to clamp the conventional doorknob between the doorknob handle and the locking ring. The kit includes a plurality of locking rings of various sizes and a locking ring wrench having a stub which seats in the slit defined in the locking ring for attaching the locking ring to the doorknob handle.

9 Claims, 4 Drawing Sheets

DOORKNOB HANDLE

BACKGROUND OF THE INVENTION

1. Field of the Invention

The present invention relates to lever type door handles, and more particularly to an adapter for retrofitting conventional doorknobs with a lever type door handle.

2. Background of the Invention and Discussion of the Related Art

The conventional doorknob is a well accepted part of society. However, it is not well received by all. Some people, particularly the physically challenged, cannot grip and turn a conventional doorknob. Conventional doorknobs are rounded protuberances at the end of the shaft, and require the physical dexterity and grip strength to place the fingers and thumb around the rounded protuberance, to grip the knob tightly, and to rotate the knob. Persons lacking such dexterity and grip strength are forced to leave doors open, allowing the world's prying eyes to witness every private moment. Thus, there is a definite and apparent need for means attachable to a doorknob to make it possible to rotate it without gripping the knob, and with the exertion of only a minimal amount of force. Thus, a doorknob handle solving the aforementioned problems is desired.

This problem and proposed solutions for the problem appear have been addressed in prior patents. U.S. Pat. No. 4,285,536, issued on Aug. 25, 1981 to McCoy, et al., discloses a universal level handle attachment for a doorknob. Installation of the McCoy door handle requires the dexterous use of a screw driver.

U.S. Pat. No. 4,397,489, issued on Aug. 9, 1983 to Willard H. Lind teaches a door handle with elastomeric material placed on either or both sides of the knob. The rings increase the friction and prevent slipping of the adapter. These rings also add to the cost of the handle, and make installation more difficult.

None of the above inventions and patents, taken either singularly or in combination, is seen to describe the instant invention as claimed.

SUMMARY OF THE INVENTION

The present invention pertains to doorknob handles. Specifically, the present doorknob handle provides doorknob handles for retrofitting conventional doorknobs, a kit for the doorknob handle's installation, and a method for using the kit to install the doorknob handle.

The doorknob handle assembly features two components: a locking ring and a doorknob handle. Installation requires joining the two components to cooperatively grip the original doorknob. Doorknobs vary in size and shape, so one embodiment of the present invention is a kit that provides a number of locking rings. The rings are varied in size and shape, so that a ring may be selected that best accommodates a particular doorknob. The kit also includes a wrench for use in joining the locking ring and the doorknob handle. Although the wrench is specially designed for installation of the doorknob handle assembly, it should be saved, so that the handle can be detached and perhaps moved to another knob. The handle and ring are constructed of plastic, which improves the gripping properties, while leaving the original knob unscathed. After removal, one would never know that a doorknob handle assembly had previously been attached.

Accordingly, it is a principal object of the invention to provide a doorknob handle for use by physically challenged individuals.

It is another object of the invention to provide a kit which includes everything one would need to attach a doorknob handle to a doorknob.

It is a further object of the invention to provide a doorknob handle that easily attaches to a doorknob.

Still another object of the invention is to provide a doorknob handle that easily detaches from a doorknob, leaving the doorknob unscathed, and the doorknob handle ready for reattachment on another doorknob.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to a doorknob handle, a kit for the door handle's installation, and a method for using the kit to install the doorknob handle. The doorknob handle will first be discussed with reference to FIG. 1.

Figure 1:
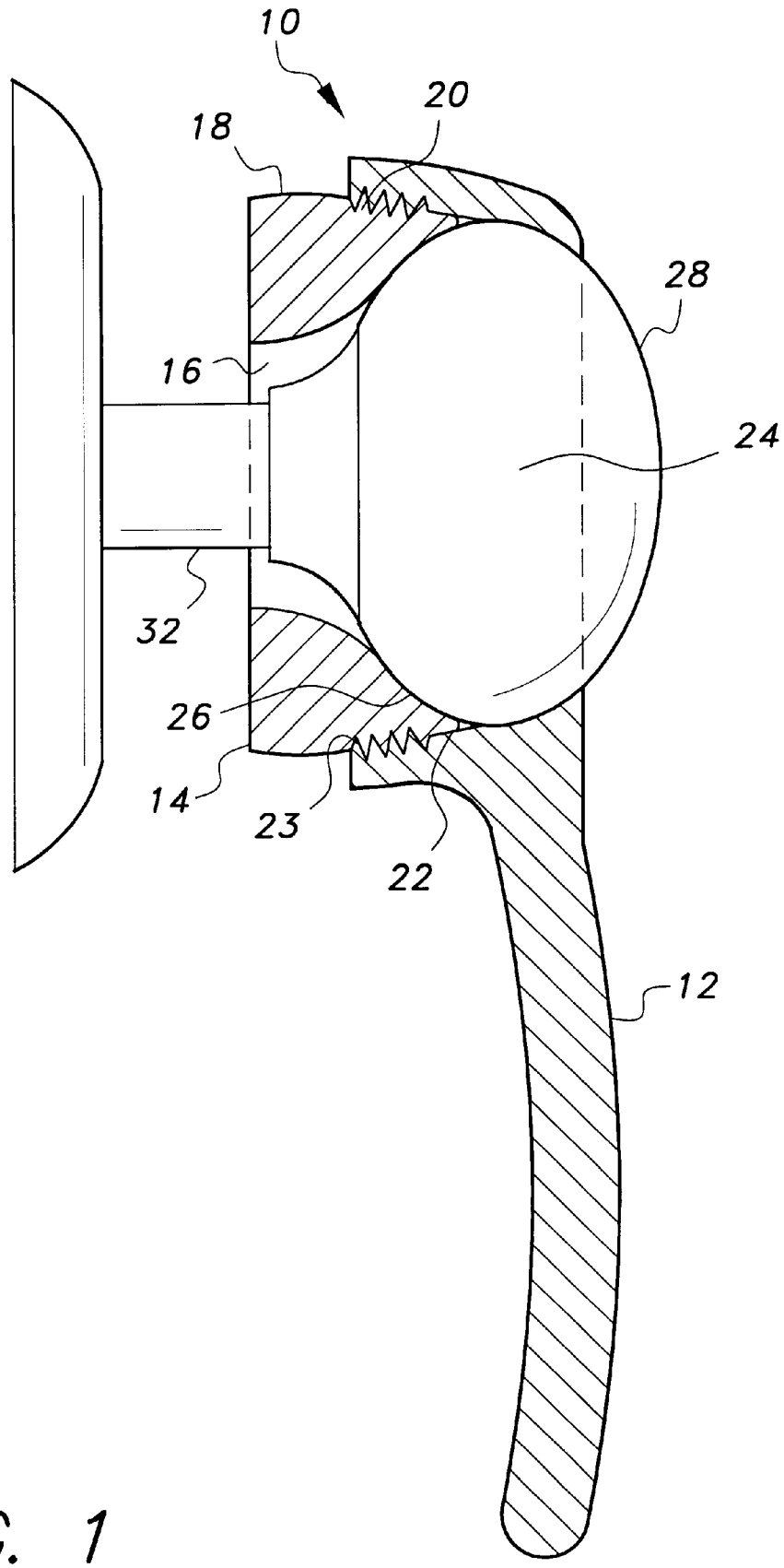
FIG. 1 is a cross-sectional view of a doorknob handle according to the present invention.
Figure 3:
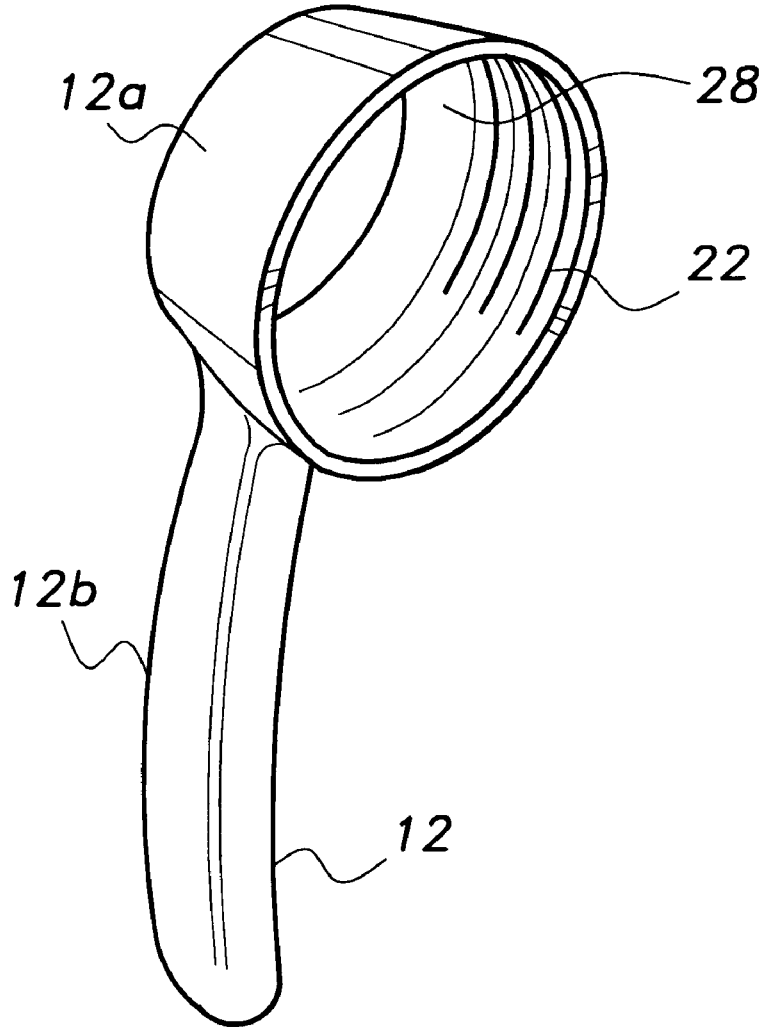
FIG. 3 is a perspective view of a doorknob handle showing threads and the interior of the handle.

The doorknob handle assembly, generally referred to as 10 in FIG. 1, features two main components: a doorknob handle 12, and a locking ring 14. The doorknob handle 12 comprises a ring 12*a* and an elongated lever 12*b* extending radially from the outer circumference of the ring 12*a*. The ring 12*a* may frusto-conical shaped or tapered so that the circumference of the inner face of the ring 12*a* is large enough to fit over the doorknob 24 at its largest diameter, while the circumference of the outer face of the ring 12*a* is smaller than the doorknob 24 at its largest diameter. The locking ring 14 has an interior surface 16 and an exterior surface 18. The locking ring's exterior surface 18 features threads 20 defined therein. The ring 12*a* of the doorknob handle 12 has an interior surface 22, and this interior surface 22 also features threads 23 defined therein. The threads 23 on the handle 12 engage the threads 20 on the locking ring 14 in order to firmly attach the handle assembly 10 to a conventional doorknob 24. To aid in attachment, the interior locking ring surface 16 is shaped to conform to the contours of the underside 26 of the doorknob 24. Likewise, as shown in FIG. 3, the doorknob handle 12 has a thread-free portion 28 on its interior surface 22, which is shaped to conform to the contours of the doorknob's outer face 28. Hence the outer circumference of the doorknob 24 is clamped between the locking ring 14 and the handle 12.

Figure 2:
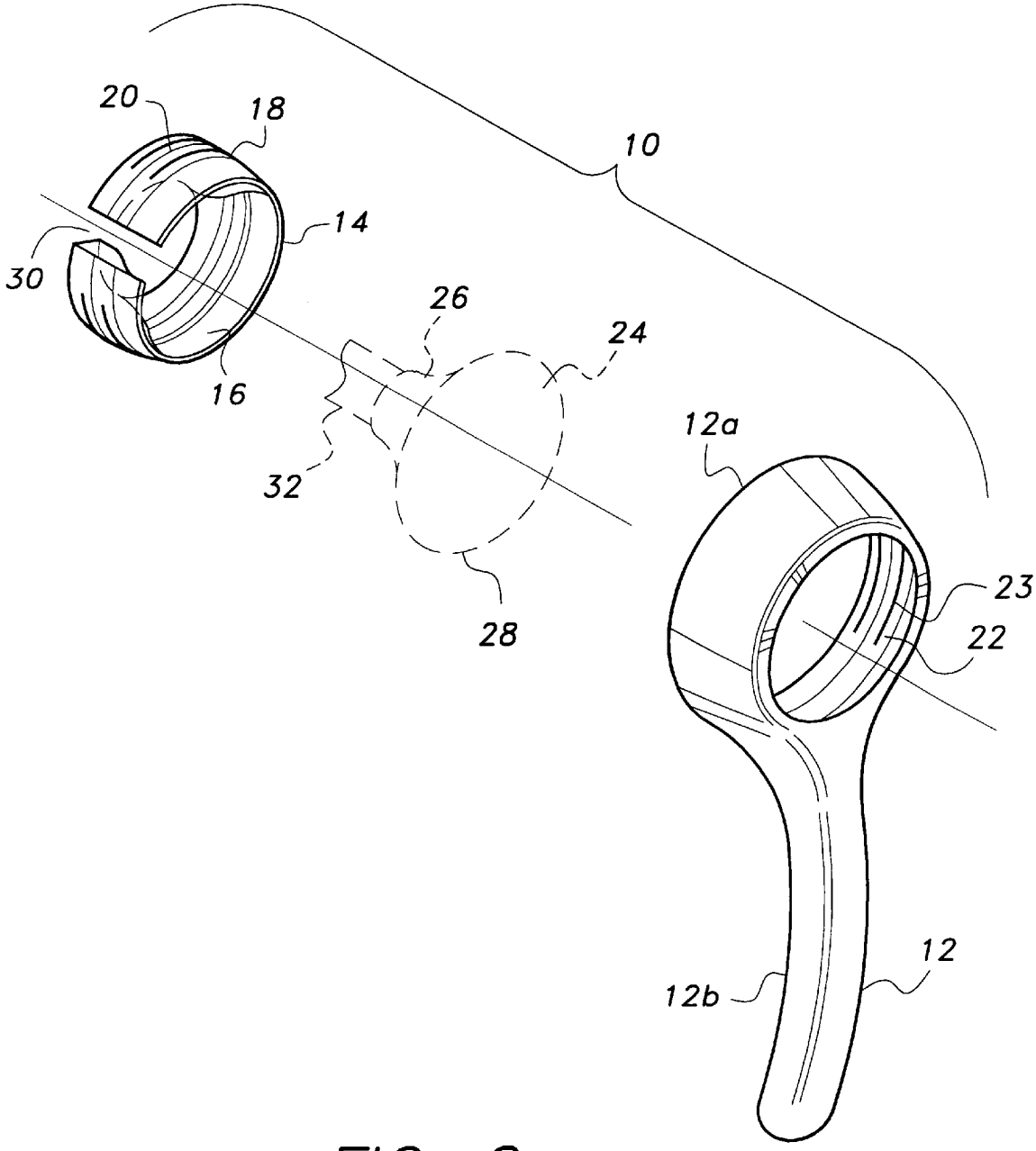
FIG. 2 is an exploded, environmental view of a doorknob handle according to the present invention.

The locking ring 14 has a slit 30 defined therein, so that it is shaped like a split ring, as is apparent in FIG. 2. The slit 30 allows placement of the locking ring 14 around the neck of the doorknob 32, and also provides a seat into which a locking ring wrench 34 may fit.

Figure 4:
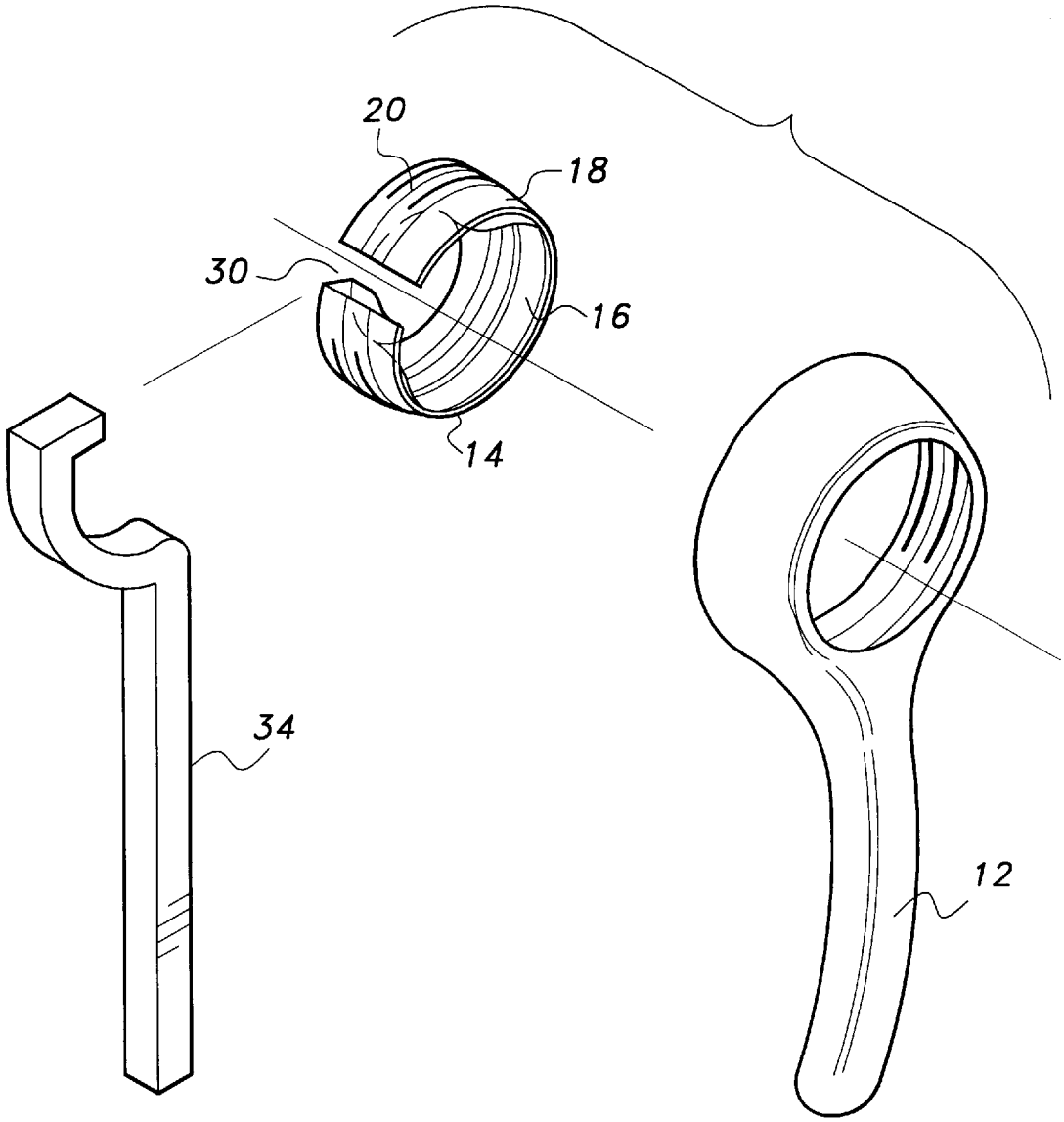
FIG. 4 is a perspective view of threaded locking ring, locking ring wench, and handle grouped as a kit.

In FIG. 4, we see all the components of the doorknob assembly installation kit. The kit includes a locking ring 14, a doorknob handle 12, and a locking ring wrench 34. The locking ring wrench 34 has an elongated handle, an arcuate neck shaped like a 90° arc having one end of the arc attached to one end of the handle, and a stub attached to the other end of the arc extending normal to the handle and coplanar with the arcuate neck, the end of the stub being sized and dimensioned to seat in the slit 30 defined in the locking ring 14.

To install the doorknob assembly, one first selects an appropriately sized locking ring to fit the doorknob 24. The user then places the ring 14 around the doorknob's neck 32, and places the doorknob handle 12 over the doorknob face 28. The locking ring wrench 34 is then inserted into the locking ring's slit 30. While the installer holds the doorknob handle 12 stationary, he turns the locking ring wrench 34. Turning the locking ring wrench 34, causes the locking ring 16 to turn as well. The threads 20 and 23 on the ring's and handle's opposing surfaces engage each other. The installer stops tuning the wrench 34 when the doorknob handle 12 is securely fixed to the face of the doorknob. The doorknob handle assembly 10 may be removed by reversing the installation steps.

The present attachment may be secured at any angle throughout a complete revolution and still function in the designed manner, thus providing the maximum of universality. Advantageously, the elongated lever 12*b* of the doorknob handle 12 is easier for the physically challenged to manipulate than a conventional rounded doorknob 24.

It is to be understood that the present invention is not limited to the embodiment described above, but encompasses any and all embodiments within the scope of the following claims.

We claim:

1. A doorknob handle assembly for attachment to a conventional rounded doorknob having a shaft, the assembly comprising:

a locking ring having an exterior locking ring surface and interior locking ring surface, the locking ring being sized and dimensioned for encircling the shaft of the conventional rounded doorknob, the locking ring having a slit defined therein for allowing placement of the locking ring around the shaft of the doorknob and for receiving a locking wrench; and a doorknob handle having a handle ring and an elongated lever extending radially from an outer circumference of the handle ring, the handle ring having an interior doorknob handle surface, the interior doorknob handle surface engaging the locking ring in order to clamp the conventional rounded doorknob between said locking ring and the doorknob handle.

2. The doorknob handle assembly of claim 1, wherein the exterior locking ring surface and the interior doorknob handle surface are threaded, said doorknob handle threadedly engaging said locking ring in order to releasably clamp the conventional rounded doorknob between said doorknob handle and said locking ring.

3. The doorknob handle assembly of claim 1, further including the locking wrench, the wrench having a stub for engaging the slit of the locking ring for urging the locking ring against the doorknob handle.

4. The doorknob handle assembly of claim 1, wherein the doorknob handle interior is shaped so as to conform to contours of a conventional rounded doorknob face.

5. The doorknob handle assembly of claim 1, wherein the interior locking ring surface is shaped so as to conform to contours of a conventional rounded doorknob underside.

6. The doorknob handle assembly of claim 1, wherein the locking ring is made of plastic, thereby allowing the ring to frictionally grip the conventional rounded doorknob.

7. A kit for the installation of a doorknob handle assembly comprising:

a locking ring having a threaded exterior surface and having a locking ring slit defining a seat;

a doorknob handle having a handle ring and an elongated lever extending radially from an outer circumference of the handle ring, the handle ring having a threaded interior surface, whereby said locking ring releasably engages said doorknob handle; and a locking ring wrench having a handle, and arcuate neck, and a stub, the stub engaging the seat defined in the locking ring in order to turn the locking ring.

8. The kit of claim 7, further comprising a plurality of various sized threaded locking rings, thereby allowing installation around a variety of different sized conventional rounded doorknobs.

9. A method for the installation of a doorknob assembly, comprising the steps of:

selecting an appropriately sized locking ring having a locking ring slit defined therein and having a threaded exterior surface;

placing the locking ring around a conventional doorknob neck;

placing a doorknob handle having a threaded interior surface over a conventional doorknob face;

inserting a locking ring wrench into the locking ring slit;

holding the doorknob handle stationary;

turning the locking ring wrench, thereby turning the locking ring in order to threadedly engage the doorknob handle; and ceasing to turn the locking ring when the doorknob handle is fixed to face of doorknob.

* * * * *